United States Patent [19]

Babington

[11] Patent Number: 4,495,777

[45] Date of Patent: Jan. 29, 1985

[54] LOAD SHAVING SYSTEM

[76] Inventor: Thomas G. Babington, 913 S. Hohokam Dr., Tempe, Ariz. 85281

[21] Appl. No.: 456,703

[22] Filed: Jan. 10, 1983

[51] Int. Cl.[3] ..... F25D 17/02; B60H 1/00

[52] U.S. Cl. ..... 62/185; 62/179; 62/184; 165/34; 165/39; 165/40

[58] Field of Search ..... 62/185, 179, 180, 181, 62/183, 184, 201, 171, 121, 332, 305; 165/39, 40, 34

[56] References Cited

U.S. PATENT DOCUMENTS

| | | | |
|---|---|---|---|
| 1,718,815 | 6/1929 | Fleisher | 62/121 X |
| 2,018,453 | 10/1935 | Lawler | 62/311 X |
| 2,048,661 | 7/1936 | Lawler | 62/332 X |
| 2,126,266 | 8/1938 | Laird | 62/88 |
| 2,239,594 | 4/1941 | Cummings, Jr. | 62/185 X |
| 2,272,083 | 2/1942 | Candor | 62/97 |
| 2,286,316 | 6/1942 | Snook | 62/158 |
| 2,352,282 | 6/1944 | Newton | 62/175 |
| 3,102,399 | 9/1963 | Meckler | 62/332 |
| 3,995,443 | 12/1976 | Iversen | 62/305 |
| 4,144,723 | 3/1979 | Morse et al. | 62/332 |
| 4,270,362 | 6/1981 | Lancia et al. | 62/182 X |
| 4,277,952 | 7/1981 | Martinez, Jr. | 62/305 X |
| 4,313,310 | 2/1982 | Kobayashi et al. | 62/332 X |
| 4,315,404 | 2/1982 | Schmitt et al. | 62/332 X |

*Primary Examiner*—Harry Tanner

*Attorney, Agent, or Firm*—LaValle D. Ptak

[57] ABSTRACT

A load shaving system for a closed loop cooling system adds a secondary heat exchange unit in shunt in the closed loop system between the output side of the load and the input to the primary heat exchange unit. The secondary heat exchange unit has constant or variable amounts of the return fluid from the load shunted through it in response to the temperature difference between the temperature of the return fluid and the temperature of the cooling medium used in the secondary heat exchange unit, which typically may be a plate and frame heat exchanger or the like. Part or all of the required temperature drop for the fluid in the closed loop system may be obtained from the secondary heat exchanger.

9 Claims, 2 Drawing Figures

LOAD SHAVING SYSTEM

BACKGROUND OF THE INVENTION

With the significant increases in energy costs which have taken place over the last few years, it has become essential, particularly for large installations, to find ways to reduce the energy consumption of cooling systems to make them more economical to operate. In recent years many steps have been taken to improve the insulation factors of buildings and to minimize the leakage of air from the buildings in order to reduce the costs of cooling such buildings.

The primary focus for reducing the costs of cooling buildings, however, must be concentrated on the cooling apparatus itself. It is possible to reduce the amount of energy consumed by such apparatus, even by a small percentage, significant savings in operating costs over a period of time can be realized. Many installations currently employ a closed loop cooling system in which the coolant for the system passes from a load (where it picks up heat) through an evaporator in a chiller and back to the load. The chiller includes a compressor and a condenser and in many installations the coolant for the condenser is water which is circulated in an open loop from the condenser to spray nozzles in a cooling tower. The water collected at the base of the cooling tower then is supplied back to the condenser to permit heat exchange between the condenser in the open loop, the compressor, and the evaporator in the closed loop. Thus, in the chiller, heat is given up by the coolant fluid in the closed loop through the evaporator to the water in the open loop in the condenser and the cycle continuously repeats.

It has been discovered that under some ambient conditions, "free" cooling can be realized without the expensive operation of the chiller or primary heat exchange unit. One approach for accomplishing this is disclosed in the patent to Newton U.S. Pat. No. 2,352,282. Newton discloses a system which has two heat exchange coils located in series in the air duct of the air conditioning system. One of these coils is supplied with a low cost coolant, such as a supply of city water. Upon initial demand for cooling, the water cooling coil is the only one used. As demand for cooling increases, a conventional mechanical refrigeration coil is used to remove heat from the air passing through the duct; and the water cooling coil is turned off. As still further increases in demand for cooling exist, the water cooling coil is turned back on to operate in conjunction with the mechanical refrigeration coil. The two cooling loops are independent of one another except for the heat exchange units located in the air duct. Due to the fact that there are two coils located in series in the air duct, increased static pressure loss with associated higher energy costs for moving a unit of air exists in this system.

A different attempt in a commercial system for supplementing the cooling which is attainable from a primary heat exchange unit is disclosed in the patents to Morse U.S. Pat. No. 4,144,723 and Schmitt U.S. Pat. No. 4,315,404. These systems both require storage reservoirs. Whenever the primary heat exchange device cannot provide a cold enough fluid temperature, the fluid is supplied through an after cooler to lower the fluid temperature before it is supplied to the load. The systems are used on days of peak ambient dry bulb temperature; and in order to be effective, require a substantial storage system or storage capability for the coolant used in the after cooler or secondary heat exchange device.

Some installations also presently use an either/or arrangement of different heat exchangers (Iversen U.S. Pat. No. 3,995,443). A primary mechanical refrigeration unit or heat exchange unit is employed to handle the cooling in the system whenever relatively high ambient temperatures exist. A secondary system is used whenever the ambient dry and/or wet bulb temperatures are such that an evaporative cooling system is capable of handling the load. In such systems, either one or the other of these two heat exchange systems or devices is used. Most frequently the load is shifted from one to the other manually or in some cases by using an automotive control system responsive to preestablished set point conditions. Thus, the secondary system is used when it is considered capable of handling the load. The load then is shifted back to the primary mechanical unit when the secondary system is no longer considered capable of handling the load. The conditions for using the secondary heat exchange system are that the ambient dry and/or wet bulb temperatures must be low enough for the secondary system to produce a fluid temperature below that which is required leaving the primary heat exchange apparatus at the time the secondary apparatus is used. Because of the manner in which these "either/or" systems function, they are relatively limited in the number of hours or days during which the more economical secondary evaporative cooler heat exchange unit is actually utilized.

It is desirable to provide a system which automatically provides load shaving for the primary heat exchange apparatus in a cooling system, and which does this in a manner to reduce the energy requirements of the overall heat exchange system.

SUMMARY OF THE INVENTION

Accordingly it is an object of this invention to provide an improved cooling system.

It is another object of this invention to provide an improved close loop cooling system.

It is an additional object of this invention to provide an improved cooling system to reduce the energy requirements of a primary heat exchange unit by incorporating a secondary heat exchange unit which consumes little or no additional energy and which removes at least a portion of the load from the primary heat exchange unit.

It is a further object of this invention in an air conditioning system to divert coolant in the closed loop system through a secondary heat exchanger located in front of the primary heat exchanger in response to preestablished temperature differences for reducing the temperature of the working fluid prior to supplying it to the primary heat exchanger for further reducing its temperature.

In accordance with the preferred embodiment of this invention, a load shaving system is provided for a closed loop cooling system. The refrigerant or cooling fluid in the closed loop is circulated through a load to remove heat from the load in a conventional fashion. After leaving the load, this fluid is supplied to a conventional primary heat exchange unit where heat is withdrawn from the working fluid prior to applying it back to the load. A secondary heat exchange unit, however, is located in a shunt path between the load and the primary heat exchange unit; and, depending upon the temperature difference existing between the cooling medium used in the secondary heat exchanger and the temperature of the working fluid exiting from the load, a portion of the working fluid is passed through the secondary heat exchange unit to drop the temperature of the working fluid prior to supplying it to the primary heat exchange unit. Either part of or all of the cooling requirements for the working fluid in the closed loop system can be provided by the secondary heat exchanger.

DETAILED DESCRIPTION

Figure 1:
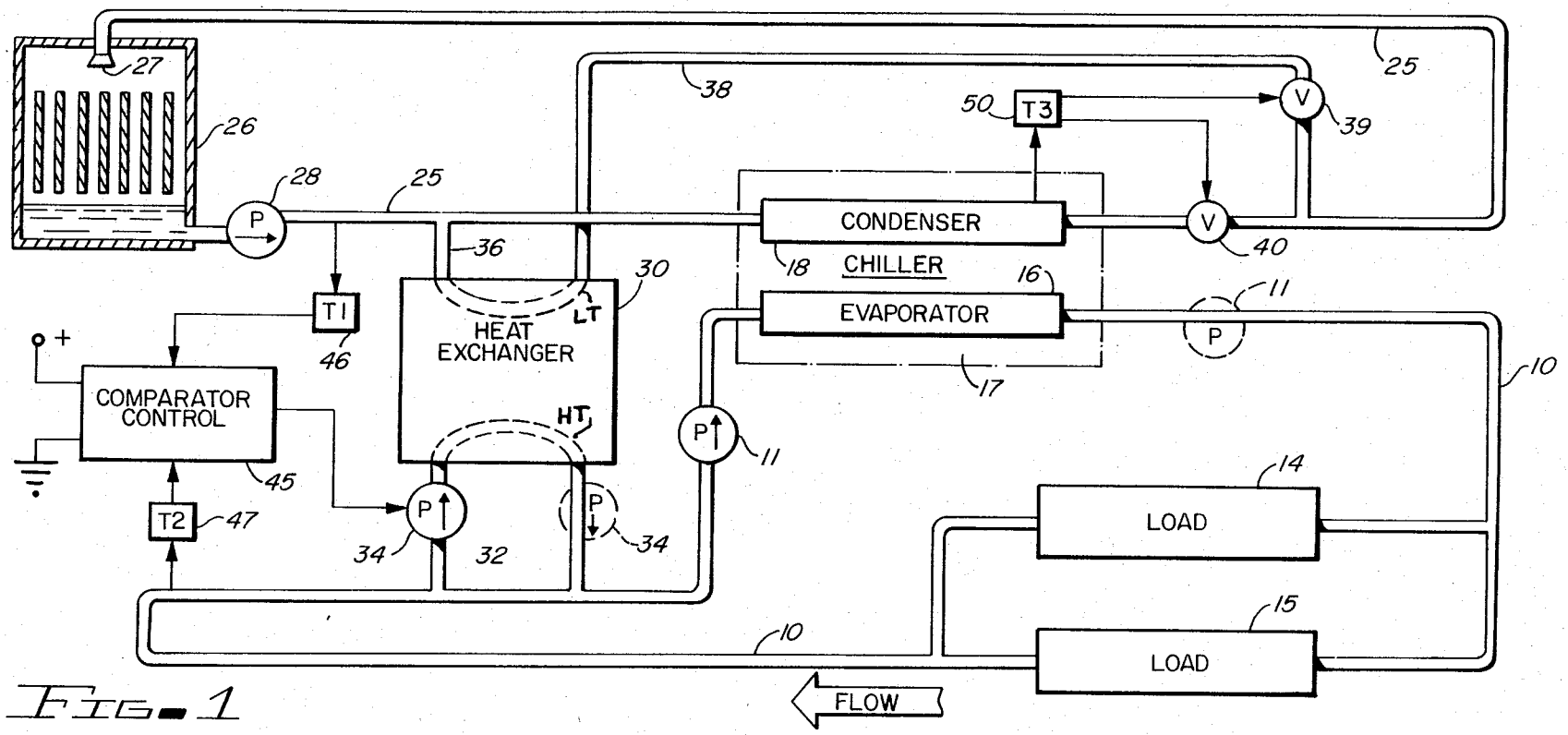
FIG. 1 is a schematic representation of a cooling system incorporating the features of a preferred embodiment of the invention.

Reference now should be made to the drawing in which the same reference numbers are used in both figures to designate the same or similar components.

FIG. 1 is a schematic representation or flow diagram of a typical chilled water cooling system with which the invention is particularly applicable. This system includes a closed loop fluid recirculating system for moving chilled water (or other suitable coolant) through a loop or pipe 10 by the operation of a pump 11 located between the outlet side of a typical load 14, 15, and the input to an evaporator section 16 of a chiller 17. An alternative location for the pump 11 is between the outlet side of the evaporator 16 and the inlet sides of the loads 14 and 15, as indicated in dotted lines in FIG. 1. It also should be understood that a primary-secondary pumping system could be used on the evaporator 16 of the chiller 17. Typically, for a commercial installation, the pump 11 moves approximately 2.4 gallons per minute of water through the evaporator where the temperature of the water is cooled from approximately 55 degrees Farenheit to 45 degrees Farenheit.

The cooling of the water (working fluid) in the loop 10 is accomplished by means of heat rejection from the evaporator 16 in the chiller 17 to a condenser 18 located in a heat rejection loop 25 illustrated in FIG. 1 as being an open loop water recirculating system. This is a typical installation and includes a conventional compressor (not shown) between the evaporator 16 and the condenseer 18, with a return from the condenser to the evaporator. The manner in which the heat exchange is effected in the chiller 17, however, may be accomplished by means of a variety of conventional means, including air cooled chillers as well as the water cooled chiller 17 which is illustrated in FIG. 1.

The water which is in the open loop 25 is obtained from a cooling tower 26 from which the water at the bottom of the tower is withdrawn by a pump 28 and supplied to the condenser 18. The water in the loop 25 returns to the cooling tower 26 where it is sprayed through spray nozzles 27 into the tower. The sprayed water is cooled by evaporation, as is well known, resulting in a relativly cold reservoir of water at the bottom of the tower 26. The portion of the system which has been described thus far is conventional and is the type of system which is widely used in commercial building installations for supplying cooling. The loads 14 and 15 typically are in the form of coils located in air ducts where air is moved past the coils and gives up heat to the coils as it passes through them. However, this invention also is suitable for process loads where fluid temperatures in the range of 60° F. to 70° F. are maintained. Plastic molding machines and electronic apparatus cooling are examples of such loads.

Typical chillers 17 of the type employed in refrigeration systems of the type which have been described above generally include self contained controls which cause the chiller 17 to reduce the amount of work (or energy consumption) that the chiller does as the load coming into the evaporator 16 of the chiller 17 is reduced. Thus, if the temperature of the water supplied to the evaporator 16 in the closed loop 10 is lower, the amount of work required to be done by the chiller 17 is reduced compared to the work which is necessary when the temperature of the water in the closed loop 10 is higher. This means that lower energy consumption results for lower temperature water input through the evaporator 16 of the chiller 17.

To take advantage of this characteristic of the chiller 17 (i.e. reduced energy requirements for lower temperatures of the water coming into the evaporator 16), a secondary or supplemental heat exchanger 30 is added to the otherwise conventional system shown in FIG. 1. This secondary heat exchanger can be of a vairety of conventional types, and a typical unit 30 is in the form of a plate and frame heat exchanger. It should be understood, however, that other types of heat exchangers may be employed equally as well as a plate and frame heat exchanger. As is apparent from an examination of FIG. 1, the water coolant recirculated through the closed loop 10 also may be shunted through an auxilliary loop 32 by means of a pump 34 which will shunt constant or varying amounts through the circuit HT of the heat exchanger 30. This can be all, nothing, or any amount in between of the total flow provided by the pump 11 in the loop 10. On the other side of the heat exchanger 30, a shunt loop 36 is tapped off of the open loop 25 and passes through the circuit LT of the heat exchanger 30 through a return pipe 38 and a valve 39 to join with the loop 25 at a junction with the output from a valve 40 connected between the outlet side of the condenser 18 and the junction of the outlets of the valves 39 and 40.

When the system is at full load, the water temperature exiting from the loads 14 and 15 in the loop 10 typically is at a full 55 degree F. If, the ambient wet bulb temperature at the same time is below 55 degrees F., for example 50 degrees F., and the cooling tower is capable of producing water leaving the reservoir at the bottom of the tower at a temperature below 55 degrees F. (for example 53 degrees F.), pump 34 is started. This is accomplished by means of a comparator control system 45 which receives inputs from two temperature sensors 46 and 47. The signals representative of the temperatures sensed by the sensors 46 and 47 are compared by the comparator 45 which then provides an output signal to control the operation of the pump 34. The pump 34 can be a constant or variable speed pump.

The sensor 46 may sense any of a number of variables including the ambient dry bulb temperature, the wet bulb temperature, or the actual temperature of the water in the loop 25 as it leaves the pump 28. The wet bulb temperature is preferred since it gives a more realistic operation of the system, but either the dry bulb temperature or the actual water temperature may be used as well. Most efficient operation, however, has been found to result from using the wet bulb temperature. Whatever its source, the temperature sensed by the sensor 46 is compared in the comparator control circuit 45 with the actual water temperature sensed by the sensor 47 as the water leaves loads 14 and 15.

The valves 39 and 40 are head pressure control valves operated by a temperature sensor/head pressure system 50 which senses the head pressure of the condenser 18 in the chiller 17. The outputs of the sensor system 50 are such that the valves 39 and 40 are proportionally controlled, with the valve 39 opening up while the valve 40 closes by a like amount and vice-versa. Under the temperature conditions which have been mentioned above by way of example, the sensor system 50 operates to cause the valve 39 to be nearly wide open and the valve 40 to be nearly closed. Consequently, under certain ambient conditions, most of the water which is removed from the reservoir of the cooling tower 26 by the pump 28 passes through the loop 36 into the heat exchanger 30 and by-passes the condenser 18 flowing through the valve 39 to return back to the spray nozzle 27 in the cooling tower 26. Cooling water, however, does flow through the condenser 18 as well as the loop 36/38. This head pressure control system is typical except for the inclusion of circuit LT of heat exchanger 30 in the loop 36–38.

The size or capacity of the plate and frame heat exchanger 30 may vary considerably depending upon the parameters of a typical installation. If the secondary heat exchanger 30, however, is sized so that is is capable of lowering the temperature of the water flowing through it one degree F. for the various temperature conditions mentioned above in the example; and further if the pump 34 has the same flow as the pump 11, the heat exchanger 30 is capable of taking 1/10 of the full load of the system (where the temperature reduction is from 55 degrees F. to 45 degrees F. for the water in the loop 10). A further drop in the ambient wet bulb temperature for the same conditions of the temperature of the water in the loop 10 leaving the loads 14 and 15, will result in an even greater increase in the amount of the load which is taken or absorbed by the secondary heat exchanger 30. This can continue until, for many conditions of operation, the heat exchanger 30 handles the entire load. When this occurs, all of the water in the loop 25 passes through the by-pass loop 36 and 38 through the fully opened valve 39. Under these conditions of operation the chiller 17 is not operating and the valve 40 is fully closed. The pump 28 would continue to run even when the chiller 17 is off on temperature.

Conversely, whenever the ambient wet bulb temperature rises to a point where the cooling tower is not capable of producing water at a temperature below 55 degrees F., the pump 34 is turned off. Under this condition of operation the system operates as a conventional cooling system with all of the heat exchange requirements being obtained from the chiller 17.

Because of the use of the comparator control circuit 45 and the temperature sensors 46 and 47 along with the pump 34, the system can be used on days when the ambient wet bulb temperature never drops low enough for one of the prior art either/or systems to be used. It also is apparent that the higher the return temperature of the water (i.e. a leaving-return water reset system with a reduced load) in the closed loop 10, the more the system of this invention can be utilized to reduce the work and energy consumption of the chiller 17. It also is apparent from an examination of FIG. 1 that there is no pumping head penalty on either the pump 11 or the pump 28 caused by the use of the system.

Figure 2:
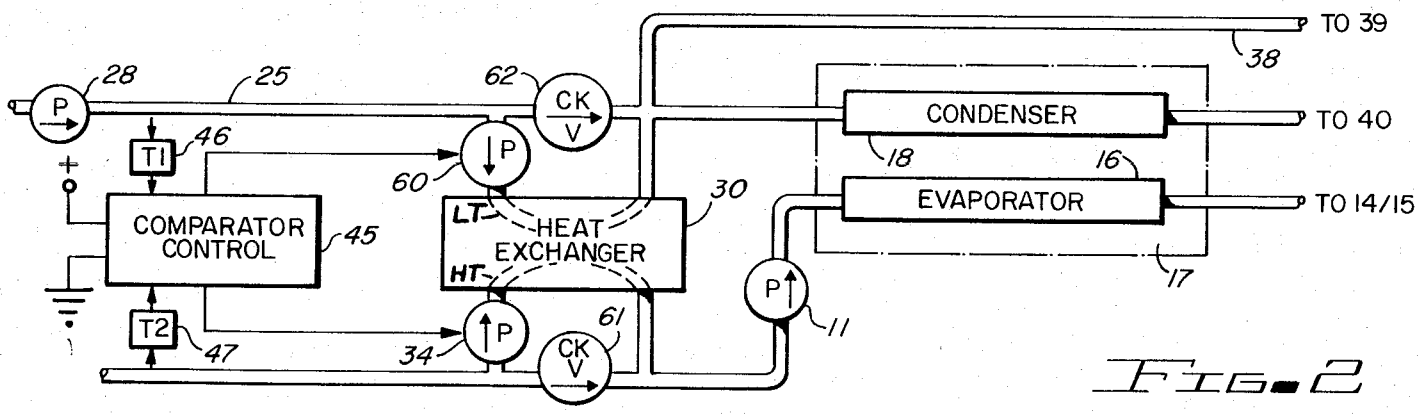
FIG. 2 is an alternative embodiment of the system shown in FIG. 1.

Reference should now be made to FIG. 2 which is a variation of the system shown in FIG. 1. The entire system has not been shown in FIG. 2 since the parts which are not illustrated are identical to those in FIG. 1. It is only in the area of the supplementary or secondary heat exchanger 30 and the comparator control circuit 45 that changes have been made. For that reason this portion of the system is shown in detail in FIG. 2.

The variation of FIG. 2 is one in which an additional pump 60 is used on the primary side of the heat exchanger 30 to move water in constant or varying amounts from the loop 25 as it exits from the pump 28. In addition, a pair of check valves 61 and 62 have been provided in each of the lines 10 and 25 as they pass the heat exchanger 30. These check valves 61 and 62, however, may not be required in most actual systems.

In the system of FIG. 2 the comparator control circuit 45 produces two outputs, one to control the operation of the pump 34 in the same manner described previously, and the other to control the operation of the pump 60. Pumps 34 and 60 are controlled together. This means that if the pumps are variable speed, the flow rate through each of them is increased in direct proportion in accordance with the signals produced by the comparator 45. The same sensors 46 and 47 supply the input signals to the comparator control circuit 45 for the operation of the pumps 34 and 60. In all other respects the system shown in FIG. 2 operates in the same manner as the system of FIG. 1, and the loop 38 may or may not be employed. It is possible to eliminate it. However, if this is done all of the water flowing in the line 25 must pass to the condenser 18. Generally it is necessary to provide some system of head pressure control for the condenser 18; so that the loop 38 and the valves 39 and 40 also could be used in conjunction with the embodiment shown in FIG. 2.

In place of using the pumps 34 and/or 60 in the by-pass loops into the heat exchanger 30, various types of diverting or mixing valves may be employed. Such valves should be automatically operated and may be placed on either the inlet or the outlet sides of the two loops into the heat exchanger 30 to cause the desired flow in both circuit LT and circuit HT of the heat exchanger. Such valves may be used with or without the pumps 34 and/or 60 and accomplish the same results as the pumps. A disadvantage of using valves, however, is that they do increase the pumping head pressure in both of the loops 10 and 25. Since they cause a variable change in pressure, it is preferable to use the pumps 34 and 60, which do not result in any changes in pumping head pressure in either of the loops 10 or 25.

Another alternative is for the chiller 17 to be an air cooled chiller. In such an event, the heat exchanger 30 also may employ an air cooled loop 36/38 independent of the chiller 17 to accomplish the same results as described above in conjunction with FIGS. 1 and 2. If such an air cooled alternative is used, the ambient dry bulb temperature is sensed by the sensor 46 and causes the pump 34 to be turned on in varying amounts in the same manner described above in conjunction with the embodiments of FIGS. 1 and 2. It also is possible to use a separate cooling tower for the heat exchanger 30 when an air cooled chiller 17 is employed. Then wet bulb temperature sensing of the same type described above in conjunction with FIG. 1 would be used for the sensor 46. Yet another alternative is to use independent cooling tower systems for the heat exchanger 30 and for the condenser 18. Once again the operation is similar to the one which has been described for the embodiments shown in FIGS. 1 and 2.

The foregoing description, taken in conjunction with FIGS. 1 and 2, is to be considered as illustrative of the invention and not as limiting. Various changes and modifications will occur to those skilled in the art without departing from the scope of the invention. Several such changes have been mentioned above. Others which will be readily apparent are variations in the coolant which is used in the loop 10 and in the loop 25. In addition it is not necessary to use cooling tower 26 in the loop 25 to cool the water (or other cooling fluid) since other devices exist for accomplishing this purpose. The invention also is applicable to absorption and other types of systems.

I claim:

1. A load shaving system for a closed loop fluid cooling system including in combination:

a closed loop fluid system for circulating working fluid through a load to remove heat from the load;

primary heat exchange means in said closed loop and having an input to receive said working fluid after passage thereof through the load to remove heat from said working fluid and having an output coupled to the load to deliver cooled fluid thereto;

secondary heat exchange means located between the load and said primary heat exchange means and having a shunt path interconnected with said closed loop working fluid system between said load and the input to said primary heat exchange means;

means for shunting at least some of said working fluid through said secondary heat exchange means;

means for providing a secondary source of cooling for working fluid shunted through said secondary heat exchange means;

first means for sensing the temperature of said working fluid after passage through the load and producing an output signal representative of such temperature;

second means for sensing a temperature proportional to the temperature of a cooling medium for said secondary heat exchange means and producing an output signal representative of such temperature; and means for comparing the signals from said first and second temperature sensing means for producing an output signal coupled with said means for shunting working fluid to vary the proportion of working fluid shunted through said secondary heat exchange means.

2. The combination according to claim 1 wherein said primary heat exchange means comprises a chiller with an evaporator therein, the input and output thereof corresponding to said input and said output of said primary heat exchange means, and having a condenser located in heat exchange relationship with said evaporator; and means coupled with said condenser for supplying a cooling medium thereto.

3. The combination according to claim 2 wherein said condenser has an input and an output, and said cooling medium supplied thereto is water; and further including a cooling tower with water pumped from said cooling tower to the input of said condenser and means for supplying water from the output of said condenser to said cooling tower to be cooled therein.

4. The combination according to claim 3 wherein working fluid is circulated through said closed loop system by means of a first pump and water is removed from said cooling tower and supplied to said condenser and said secondary heat exchange means by a second pump.

5. The combination according to claim 3 wherein the cooling medium for said secondary heat exchange means comprises water pumped from said cooling tower therethrough in heat exchange relationship with fluid shunted from said closed loop system, and further including means responsive to head pressure of said condenser in said chiller to divert varying amounts of cooling water around said condenser in accordance with the head pressure.

6. The combination according to claim 5 wherein said diverting means comprises means for supplying water in parallel from said cooling tower to said secondary heat exchange means and said condenser with the output of said condenser and the output of said secondary heat exchange means coupled together in common to the return to said cooling tower through first and second bypass valves respectively, said second bypass valve being opened in increasing amounts and said first bypass valve being closed in corresponding increasing amounts as the head pressure of said condenser drops and said first valve opening in increasing amounts and said second valve closing in corresponding increasing amounts as the head pressure of said condenser increases.

7. The combination according to claim 1 wherein said means for shunting said working fluid through said secondary heat exchange means comprises an automatically controlled pump located in the bypass loop for said working fluid through said secondary heat exchange means.

8. The combination according to claim 7 wherein the operation of said pump is controlled by the output signal from said comparing means, said pump being operated when the temperature difference between the temperature of the cooling medium for said secondary heat exchange is lower than the temperature of said working fluid exiting from the load.

9. The combination according to claim 1 wherein said primary heat exchange means comprises a chiller with an evaporator therein, the input and output thereof corresponding to said input and said output of said primary heat exchange means, and having a condenser located in heat exchange relationship with said evaporator; said means for diverting said working fluid through said secondary heat exchange means comprises a first automatically controlled pump located in the by-pass loop for said working fluid through said secondary heat exchange means and responsive to the output of said comparing means; and further including a cooling tower for supplying cooling water to said condenser as a cooling medium therefor and wherein the cooling medium for said secondary heat exchange means comprises water from said cooling tower; and a second automatically controlled pump for supplying water from said cooling tower to said secondary heat exchange means as the cooling medium therefor in response to an output signal from said comparing means.

* * * * *